US005138306A

United States Patent [19]

Mizutani

[11] Patent Number: 5,138,306

[45] Date of Patent: Aug. 11, 1992

[54] IMAGE DISPLAY DEVICE

[75] Inventor: Motoharu Mizutani, Tokyo, Japan

[73] Assignee: Kabushiki Kaisha Toshiba, Kawasaki, Japan

[21] Appl. No.: 497,199

[22] Filed: Mar. 22, 1990

[30] Foreign Application Priority Data

Mar. 24, 1989 [JP] Japan ..... 1-72309

[51] Int. Cl.[5] ..... G09G 1/06

[52] U.S. Cl. ..... 340/720; 340/736

[58] Field of Search ..... 340/720, 736, 739; 315/408, 378; 358/180, 148

[56] References Cited

U.S. PATENT DOCUMENTS 4,228,432 10/1980 Osborne ..... 340/736

4,272,808 6/1981 Hartwig ..... 340/739

OTHER PUBLICATIONS

IBM Technical Disclosure Bulletin, vol. 27, No. 10B, Mar. 1985, pp. 6094 and 6095.

*Primary Examiner*—Ulysses Weldon

*Attorney, Agent, or Firm*—Finnegan, Henderson, Farabow, Garrett and Dunner

[57] ABSTRACT

An image display device allows an electron beam to be generated upon receipt of a video signal corresponding to a display image output from memory to display a corresponding scan image on a display screen. The display screen is of such a type as to have a substantially rectangular pattern with at least one of corners curved in an arc pattern. An image display state is so controlled by a display timing generator circuit as to form an electron beam scanning point in a display area on a display raster of the fluorescent screen.

3 Claims, 9 Drawing Sheets

IMAGE DISPLAY DEVICE

BACKGROUND OF THE INVENTION

1. Field of the Invention

The present invention relates to an image display device, such as a CRT display device, which is used, for example, in an image file apparatus.

2. Description of the Related Art

In a conventional CRT display device which has been used in an image file apparatus, a display image screen corresponds to a memory, unlike an ordinary CRT of such a type as to enable an electron beam to scan the screen from edge to edge. Such a display image device does not perform an edge-to-edge scanning for economy.

The relation of a display raster to the fluorescent screen of, for example, a CRT display device is as shown in FIG. 1 where a represents the outermost peripheral edge of the fluorescent screen A of the CRT and b the outermost periphery of the display raster B. Generally, the corner A' of the fluorescent screen A in FIG. 1 is curved and the display raster B is rectangularly so shaped that an effective display area is provided on the fluorescent screen. The distance between the outermost periphery b of the display raster B and the outermost peripheral edge a of the fluorescent screen A is the smallest at each corner of the fluorescent screen in FIG. 2.

In this type of CRT display device, a display position varies due to the effect of the geomagnetism and ambient temperature for example. If a smaller clearance is provided between the outermost peripheral edge a of the fluorescent screen A and the outermost periphery b of the display raster B, the rectangular display area of the display raster B projects from the fluorescent screen A as shown in FIG. 3. It is, therefore, necessary to decrease a display area of the display raster B or to increase a CRT size. Even in a CRT whose display position, etc., undergo only a small enough variation, it is not possible to narrow the distance between the horizontal and vertical lines at the outermost peripheral edge of the fluorescent screen A and those lines at the outermost periphery of the display raster B, due to the corner of the fluorescent screen A curved, despite the fact that it is desired to take as large a display surface as possible on the display raster.

Since the rectangular display area is provided on the display raster B, an unused display area is left at the peripheral edge of the fluorescent screen and, in this sense, the phosphor screen cannot be used effectively.

SUMMARY OF THE INVENTION

It is accordingly the object of the present invention to provide an image display device capable of effectively utilizing those areas at an outer peripheral edge of a fluorescent screen which have been less utilized as unavailable areas in a conventional, rectangularly-defined display area on a display raster.

In order to achieve the aforementioned object of the present invention, there is provided an image display device comprising:

a memory means for storing a video signal corresponding to an image;

a display means having a fluorescent screen, for forming an image at a display area formed by scanning electron beam on the fluorescent screen with at least one corner curved in an arc pattern;

means for causing electron beam scanning points to be located within the display area in accordance with a fluorescent screen pattern; and means for reading out the video signal corresponding to a display image from the memory means so as to enable an electron beam to be scanned on the fluorescent screen in accordance with a display timing which is controlled by the electron beam scanning points locating means.

The image display device of the present invention can effectively utilize those areas at the outer peripheral edge of the fluorescent screen which have been less utilized as unavailable areas in a conventional image display device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An image display device according to one embodiment of the present invention will be explained below with reference to the accompanying drawings.

Figure 4:
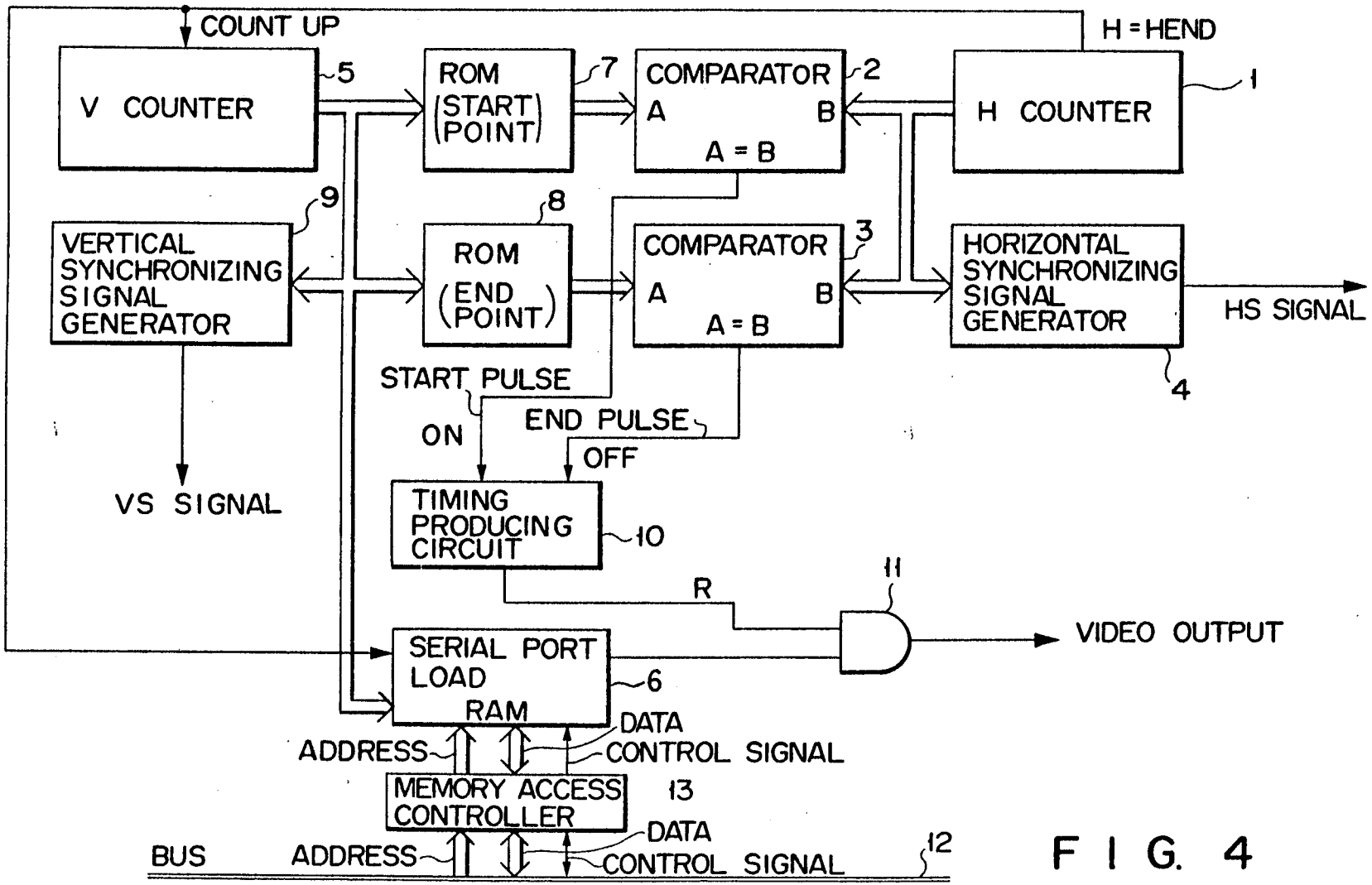
FIG. 4 is a block diagram showing a display control circuit in a CRT display device according to one embodiment of the present invention.

FIG. 4 shows a display control circuit for an image display device of the present invention, such as a CRT display device.

A H counter 1 receives video clock pulses and performs a count-up operation. The count value represents an electron beam scanning position (a brightness point) in a horizontal scanning direction on a fluorescent screen. The count value of the H counter 1, that is, a horizontal direction address value (H address), is supplied to comparators 2, 3 and horizontal synchronizing signal generator 4.

When the count value of the H counter reaches a value corresponding to a horizontal end position, a horizontal end (H end) signal is delivered to a V counter 5 and, as a serial port load signal, to a RAM6.

Figure 5:
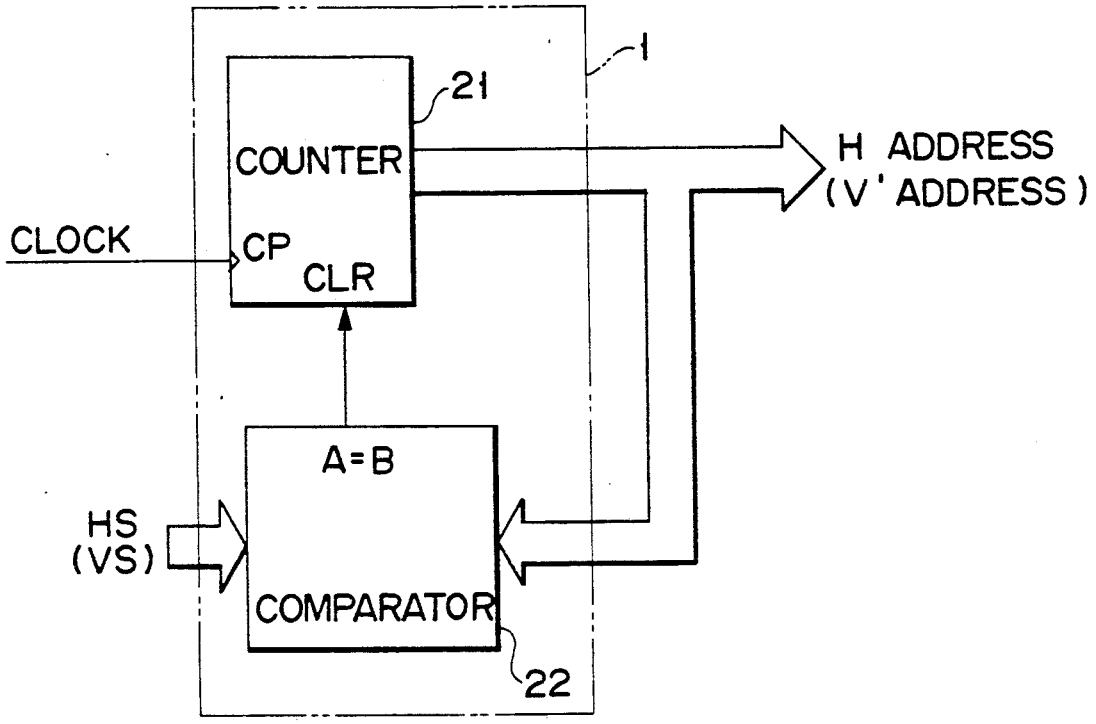
FIG. 5 is a schematic view showing H and V counters shown in FIG. 4.

The H counter 1 is composed of a counter 21 and comparator 22 as shown in FIG. 5. That is, the counter 21 counts up video clock pulses coming from an oscillator, not shown, supplies the count value as a horizontal (H) address and, when the H address coincides with the horizontal end position (HS), is cleared by a clear pulse supplied from the comparator 22 so that a counting operation is again started from "0".

The V counter 5 receives horizontal end (H end) signals from the H counter 1 and performs a count-up operation. The count value of the V counter 5 represents an electron beam vertical scanning position on the fluorescent screen. The count value, that is, a vertical address value (V address), is delivered to a ROM7 for a start point, a ROM8 for an end point, vertical synchronizing signal generator 9 and RAM6.

The V counter 5, like the aforementioned H counter 1, is comprised of a counter 21 and comparator 22, as shown in FIG. 5. That is, the counter 21 receives horizontal end signals (clock pulses) from the H counter 1 and performs a count-up operation. The count value is delivered as a V address and, when the V address coincides with the vertical end position (VS), is cleared by a clear pulse coming from the comparator 22 so that a counter is started from "0".

ROM 7 is composed of a table for storing predetermined start points (horizontal scanning start position information or raster start positions) S0, S1, S2, which are initially so determined as to correspond to the count values, that is, the vertical address values. The start points S0, S1, S2, . . . are delivered as outputs in accordance with the count values coming from the V counter 5.

For example, it is determined that the start point S0 is delivered as an output when a count value V=0 and the start point S1 at V=1. The start point is supplied from the ROM7 to the comparator 2.

The ROM8 is composed of a table for storing end points (horizontal scanning end position information or raster end positions) E0, E1, E2, . . . , and end points E0, E1, E2, . . . are delivered as outputs in accordance with count values coming from the V counter 5. It is also determined that the end point E0 is delivered as an output when the count value V=0 and the end point E1 at V=1. The end point of the ROM8 is delivered to the comparator 3.

The comparator 2 compares the start point coming from the ROM7 to the H address coming from the H counter 1 and delivers a start pulse when a coincidence occurs between the two. The start pulse coming from the comparator 2 is delivered to a timing producing circuit 10.

The comparator 3 compares the end point coming from the ROM8 to the H address coming from the H counter 1 and delivers an end pulse when a coincidence occurs between the two. The start pulse coming from the comparator 3 is delivered to the timing producing circuit 10.

The horizontal synchronizing signal generator 4 generates a horizontal synchronizing signal (HS) in accordance with the count value of the H counter 1 and a horizontal synchronizing signal (HS) is delivered to an electron beam generating section, not shown.

The vertical synchronizing signal generator 9 generates a vertical synchronizing signal (VS) in accordance with a count value of the V counter 5 and the vertical synchronizing signal (VS) is delivered to an electron beam generator, not shown.

The timing producing circuit 10 delivers an active raster period signal R over a period of time from the supply of a start pulse from the corresponding comparator 2 to the supply of an end pulse from the comparator 3. A raster period signal R from the timing producing circuit 10 is output to one terminal of an AND circuit 11.

RAM 6 is composed of a display memory and allows display data which is delivered from an external device, not shown, through a bus 12 and memory access controller 13 to be stored in the corresponding address, in accordance with the display data, address and control signal. The RAM 6 delivers, as a video signal, the display data (one pixel unit) of that address corresponding to the number of video clock pulses occurring for each generation of the V address from the V counter 5 and horizontal end signal $H_{end}$ from the H counter. The video signal from the RAM 6 is supplied to the other terminal of the AND circuit 11. The AND circuit 11 is gated, while receiving an active raster period signal R from the timing producing circuit 10, to allow the video signal coming from the RAM 6 to be output to an electron beam generating section, not shown. The electron beam generating section is responsive to the horizontal synchronizing signal (HS) coming from the horizontal synchronizing signal generator 4 and vertical synchronizing signal (VS) coming from the vertical synchronizing signal generator 9 to deflect electron beams. By so doing, the electron beams are landed on the fluorescent screen in the horizontal and vertical scanning directions.

Figure 6:
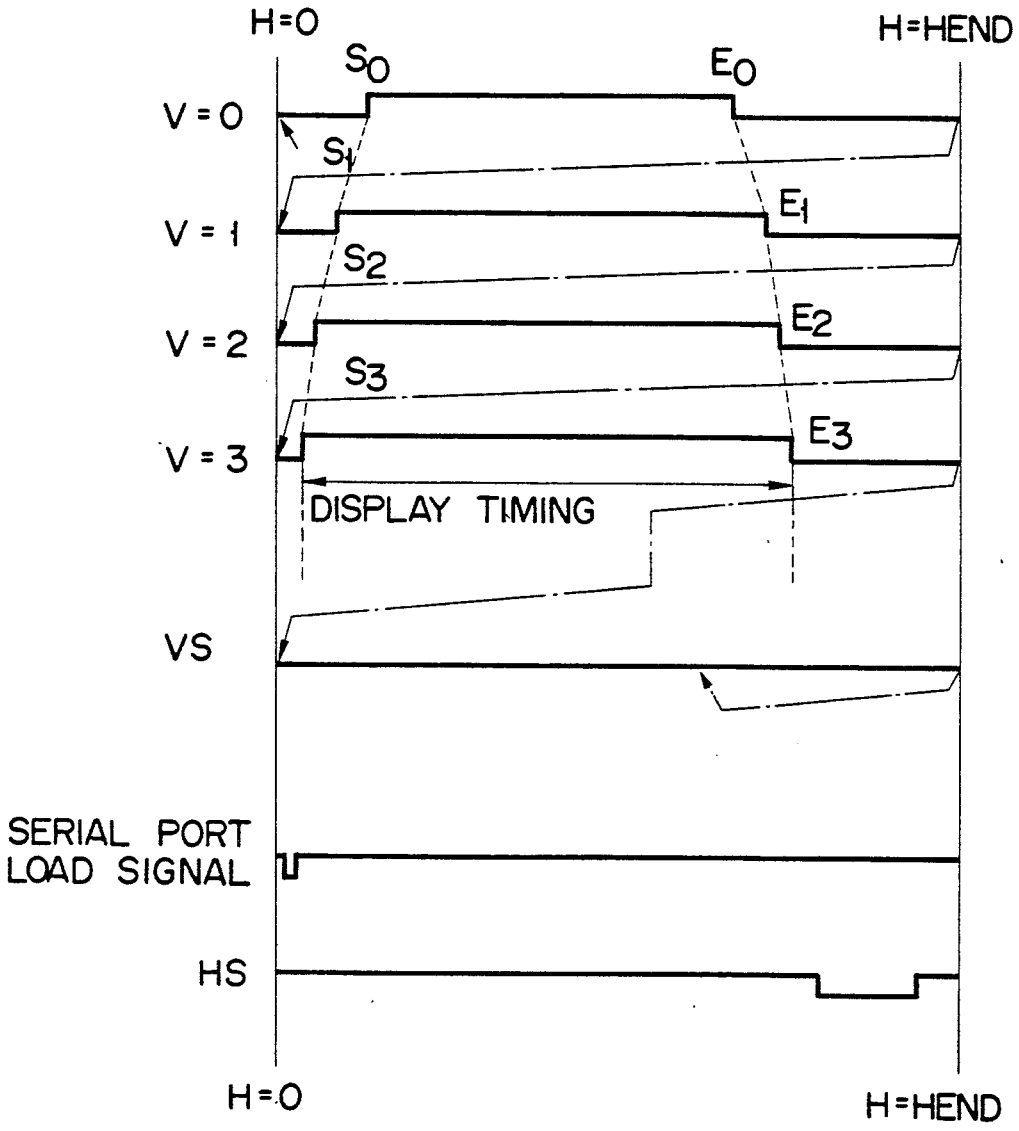
FIG. 6 is a timing chart for explaining the operation of a display control circuit shown in FIG. 4.

The operation of the image display device thus arranged will be explained below with reference to a timing chart shown in FIG. 6.

First, display data is stored in a corresponding address in the RAM 6 in accordance with the display data, address and control signal supplied via the bus 12 and memory access controller 13 from an external device, not shown.

In this state, the H counter 1 and V counter 5 are reset to generate a "0" address each. In accordance with the "0" address coming from the V counter 5, a start point S0 is output from the ROM 7 and an end point E0 from the ROM 8. The comparator 2 compares a value of a predetermined start point S0 from the ROM 7 to a "0" address coming from the H counter 1 and delivers no start pulse when there is no coincidence between the two.

Each time the video clock pulse is supplied to the H counter 1, the H counter 1 performs a count-up operation and delivers a corresponding address value to the comparator 2.

When a coincidence occurs between the value of the address coming from the H counter 1 and the output value of the start point SO coming from the ROM 7 in accordance with the count value sent from the V counter 7, the comparator 2 delivers a start pulse to the timing reproducing circuit 10. The timing reproducing circuit 10 delivers an active raster period signal R to the AND circuit 11 in accordance with the start pulse supplied. The AND circuit 11 is gated responsive to the raster period signal R. At this time, the display data of one pixel corresponding to the SO address (start point) of a first scanning line delivered from the RAM 6 is fed to an electron beam generating section, not shown, through the AND circuit 11.

Subsequently, for each supply of the video clock pulses, display data of one pixel corresponding to the start point of the SO+1 address of the first scanning line delivered from the RAM 6 is fed to the electron beam generating section, not shown, through the AND circuit 11.

When the address value coming from the H counter 1 coincides with the end point E0, the comparator 3 is delivered to the timing producing circuit 10. The timing producing circuit 10 delivers a negative raster period signal R to the AND circuit 11 in accordance with an end pulse supplied. By so doing, the AND gate 11 is closed, ceasing delivering a video signal from the AND circuit 11 to the electronic beam generating section, not shown.

When the count value of the H counter 1 reaches the end position (HS) of the horizontal direction, a horizontal end signal $H_{end}$ of the horizontal directions is delivered and, at the same time, the H counter 1 is cleared. The content of the V counter 5 is counted up by the horizontal end signal H end, delivering an 1 address. In accordance with the "1" address supplied from the V counter 5 the ROM 7 delivers a start point S1 and the ROM 8 delivers an end point E1.

When a coincidence occurs between the start point S1 coming from the ROM 7 and the H address coming from the H address 1, the comparator 2 delivers a start pulse. When a coincidence occurs between the end point E1 coming from the ROM 8 and the H address coming from the H counter 1, the comparator 3 delivers an end pulse. As a result, display data from the S1 address to E1 address delivered from the RAM 6 is supplied, as a video signal, to the electronic beam generating section through the AND gate 11.

The start and end points are updated upon each count-up operation of the V counter 5 and the corresponding display data is delivered as a video signal to the electron beam generating section.

It is to be noted that, during the period of the vertical synchronizing VS period, no raster emerges as an output because the start point does not reach the $H_{end}$ from "0".

Figure 7:
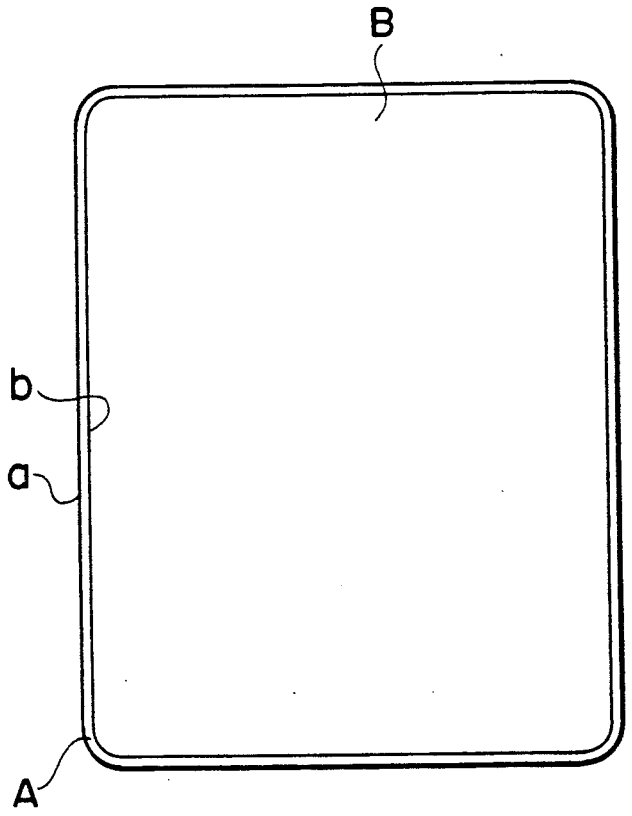
FIG. 7 shows a positional relation of a display raster to a fluorescent screen in the image display device of the present invention.

In accordance with the predetermined contents of the ROM's 7 and 8, it is possible to control the timing of the start and end of the display raster and hence to performs a proper "corner" processing on the display screen. Since the display area on the display raster is curved at the outermost periphery, that is, at each corner, it is possible to, while preventing an effect by a variation on the display position, decrease a clearance between the outermost periphery of the fluorescent surface A and that of the display raster B, as shown in FIG. 7, so that the phosphor screen A can effectively be employed.

Although, in the aforementioned embodiment, the H and V counters have been explained as being employed in combination with the corresponding comparators, the present invention is not restricted thereto. For example, either one or both the counters may be arranged as a counter shown in FIG. 8.

Figure 8:
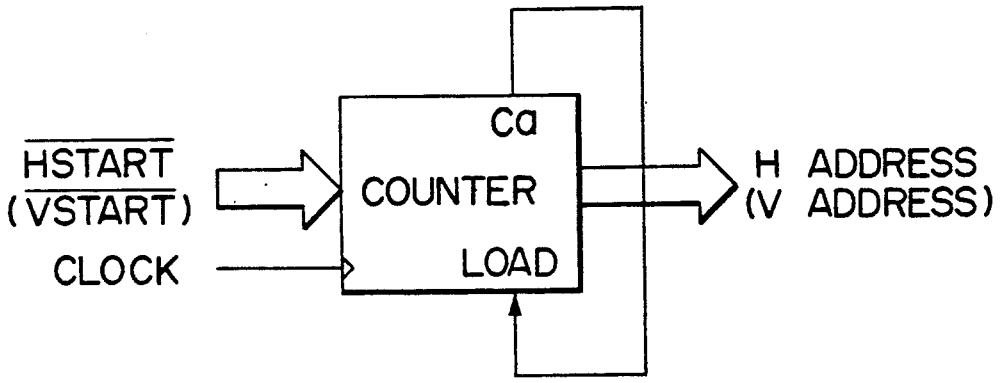
FIG. 8 is a diagrammatic view showing a variant of a practical array of H and V counters in FIG. 5.
Figure 9:
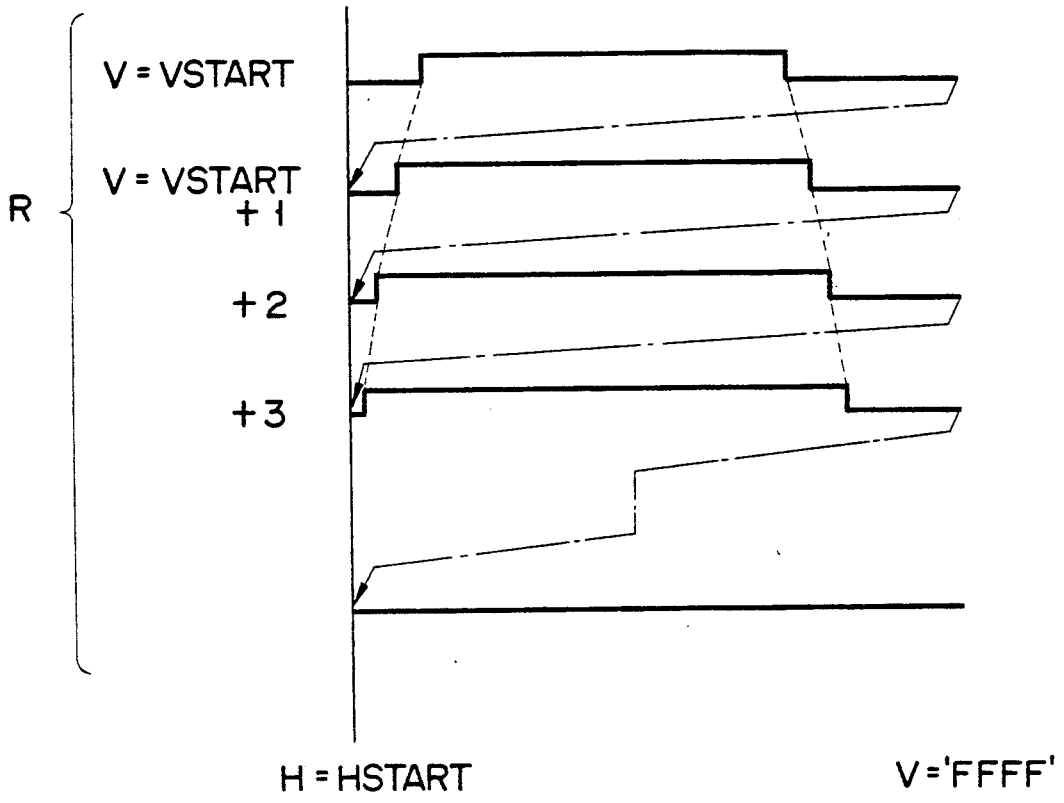
FIG. 9 is a timing chart for explaining the operation of the variant shown in FIG. 8.

If, for example, the counter shown in FIG. 8 is employed in place of the H and V counters, the operation, is performed by the timing of a timing chart shown in FIG. 9.

Although the start and end points for the respective scanning line have been explained as being stored in the aforementioned ROM, the present invention is not restricted thereto. Another logic array may be employed instead.

Figure 10:
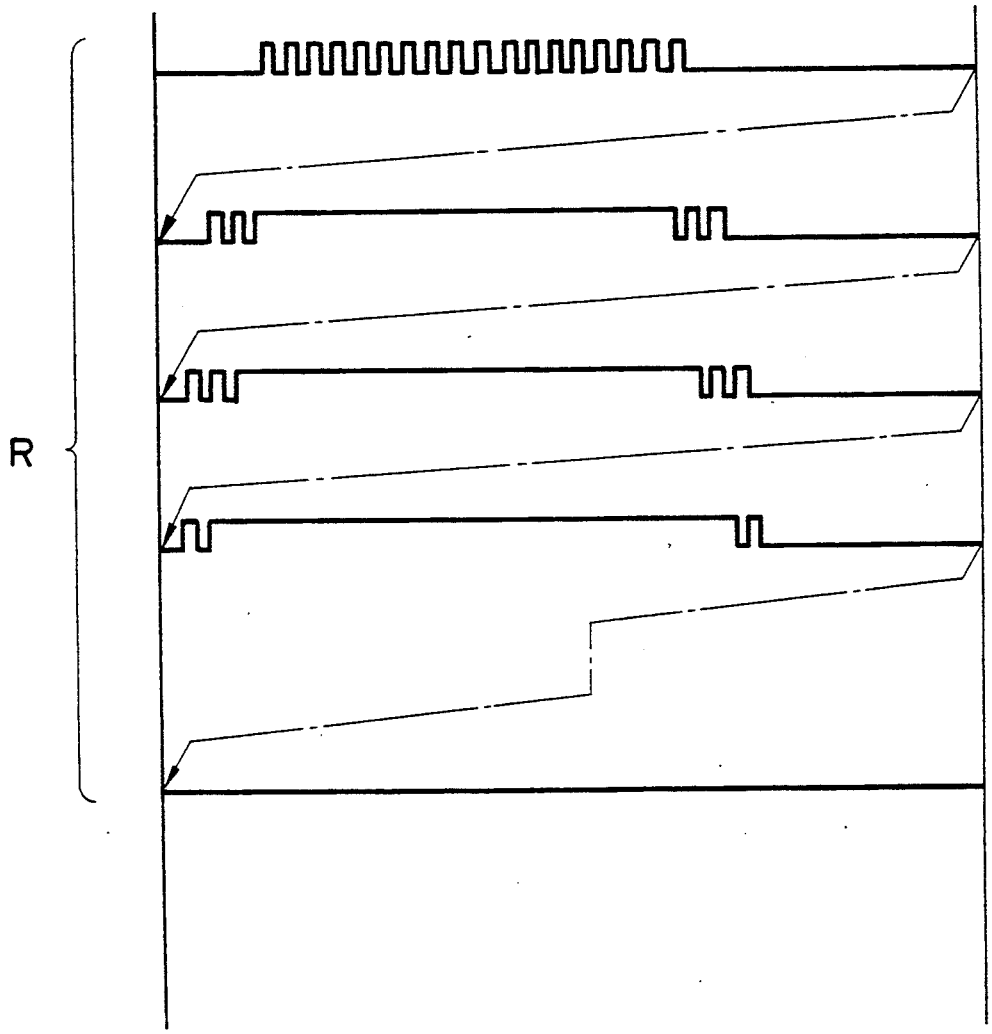
FIG. 10 is a timing chart for explaining an operation by which a display area is blurred at the outer peripheral edge of a display raster with the use of ROM's 7 and 8 in FIG. 4.
Figure 11A:
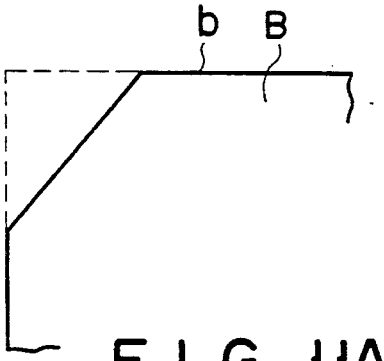
FIGS. 11A to 11F, each, show a display area pattern of a display raster.
Figure 11B:
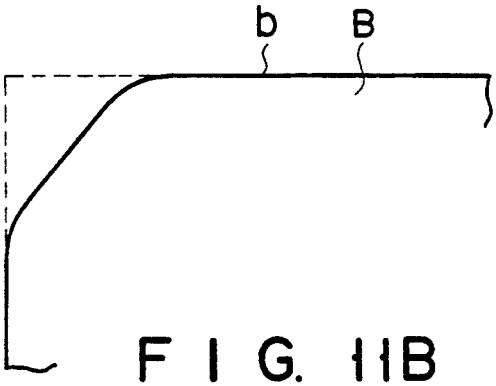
Figure 11C:
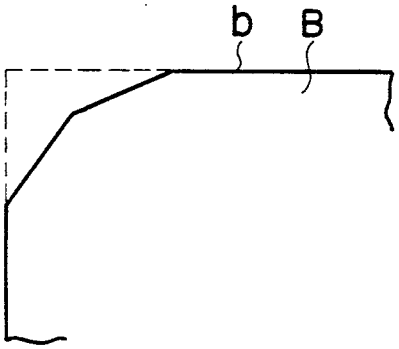
Figure 11D:
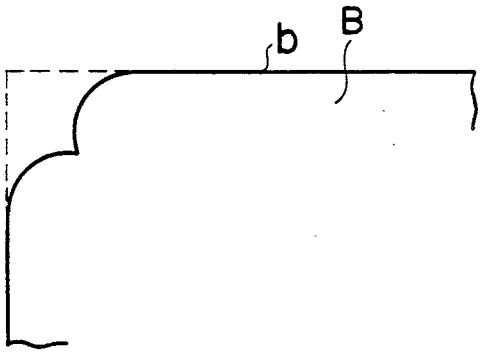
Figure 11E:
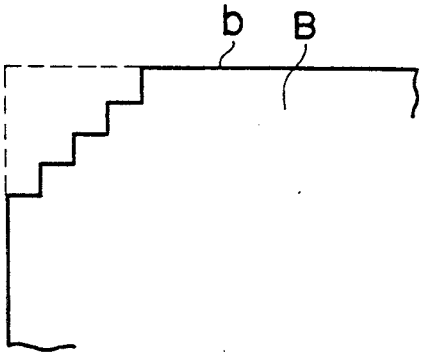
Figure 11F:
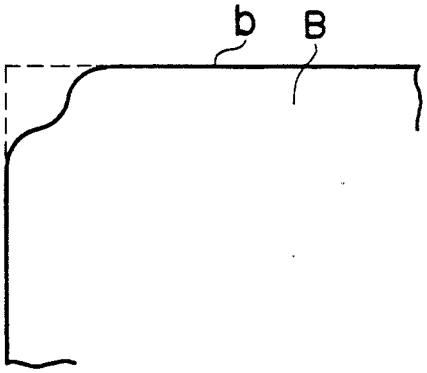

The display screen may be blurred along its full outer periphery, as shown in the timing chart shown in FIG. 10, utilizing the advantage of a ROM.

Figure 1:
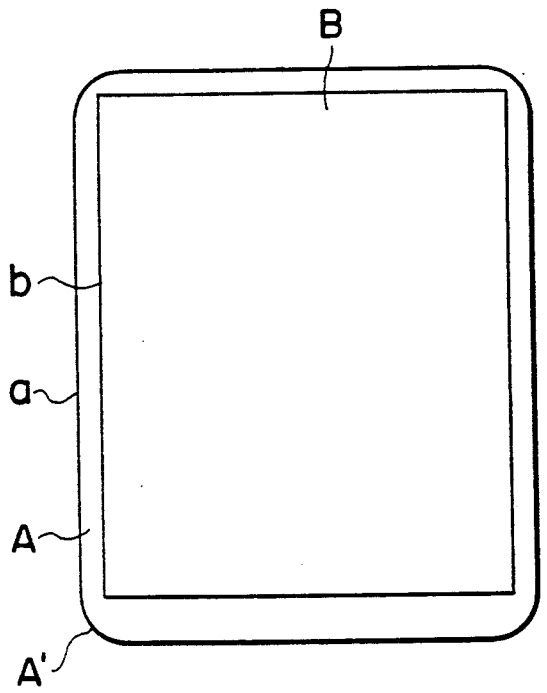
F I G. 1 (PRIOR ART)
FIG. 1 is a plan view showing a display section on a conventional image display device.
Figure 12:
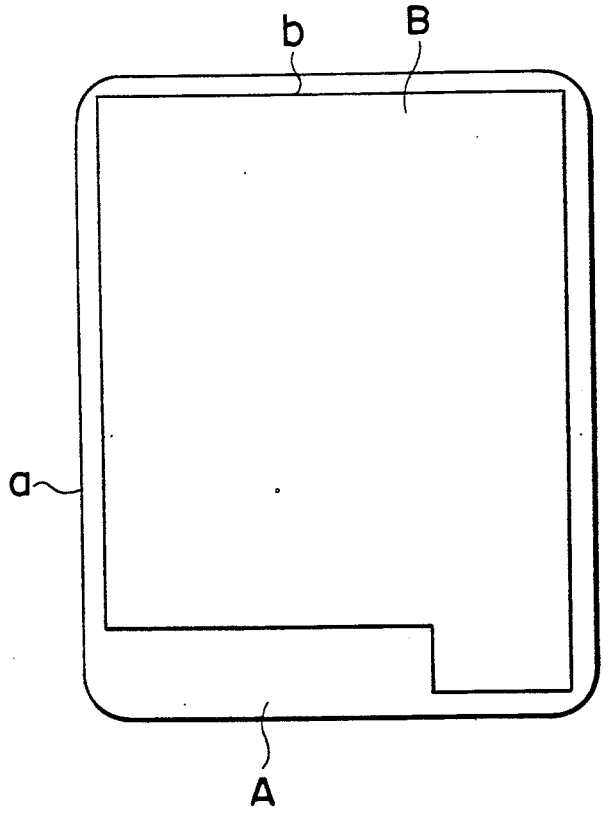
FIG. 12 shows one form of a display area of a display raster for which a non-displayed portion is formed.
Figure 2:
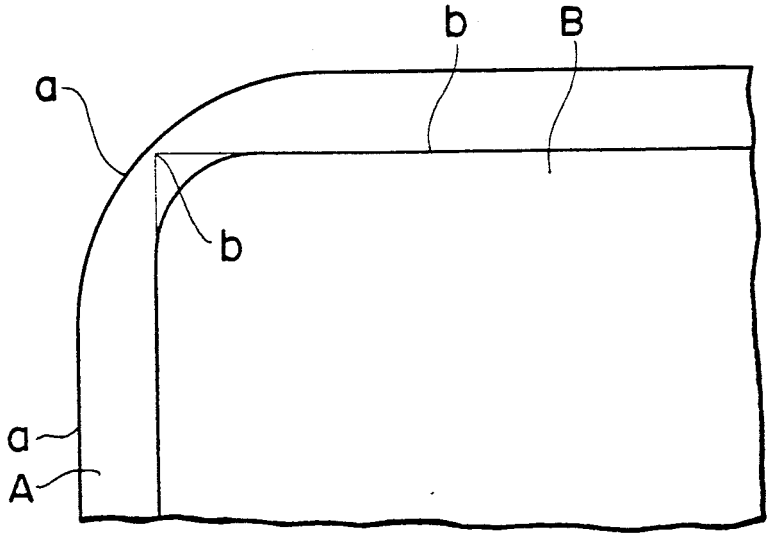
F I G. 2 (PRIOR ART)
FIG. 2 is a partial, enlarged view showing a positional relation of a display raster to a fluorescent screen of the display section.
Figure 3:
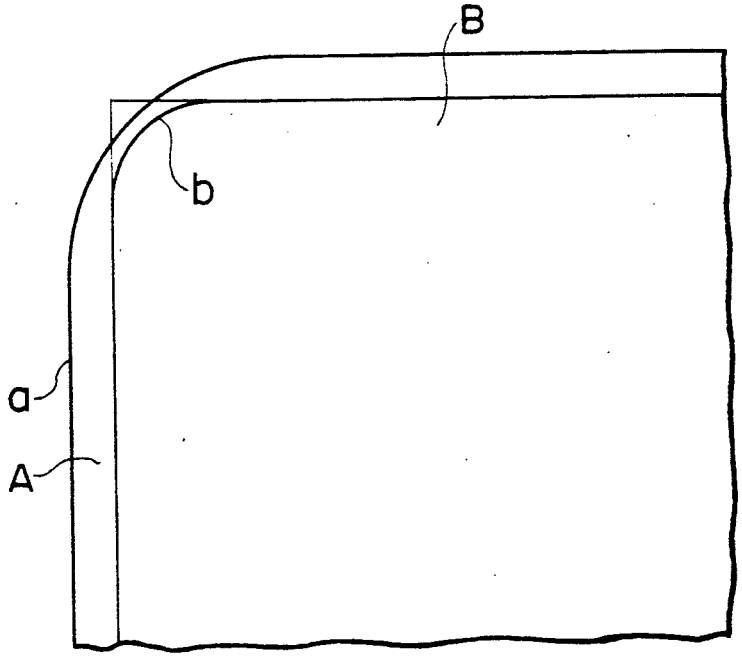
F I G. 3 (PRIOR ART)
FIG. 3 is a partial, enlarged view showing one example in which a display area on a display raster shown in FIG. 2 is externally extended from the fluorescent screen.

It is not necessarily required that the display screen be curved at each corner. As shown in FIGS. 11A to 11F, the display screen may have various patterns at each corner. If the display screen is slant at each corner, for example, it may be applied to a CRT whose corners are irregularly shaped. The display screen may intentionally be so formed as to have a non-displayed section or portion as shown in FIG. 12.

Further, during the VS period of time, a raster end pulse may stay on with a raster pattern distinguished.

It is also possible to use not only a noninterlaced scanning but also an ordinary interlaced scanning mode.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image display device for displaying image data received from an image data source, comprising:

a display means, for coupling to the image data source, including a fluorescent screen and a display area formed by scanning an electron beam on the fluorescent screen, an image being formed at the display area, said display area being formed by a display raster of said electron beam, the display area having at least one corner curved in an arc-like pattern;

means for causing electron beam scanning points to be located within the display area in accordance with a fluorescent screen pattern, said causing means comprising a first counter for counting a count value corresponding to an address of an electron beam scan on the fluorescent screen in a horizontal scanning direction and a second counter for counting in a line-by-line unit a count value corresponding to an address of an electron beam scan on the fluorescent screen in a vertical scanning direction;

means for determining a timing of the electron beam scanning on the fluorescent screen, said determining means including a first ROM connected to the second counter, for storing raster start points which correspond to count values of the second counter; a first comparator connected to the first counter, for comparing raster start point data stored in the first ROM and horizontal address values from the first counter and for generating a start pulse when there is a coincidence therebetween; a second ROM connected to the second counter, for storing raster end points which correspond to count values of the second counter; a second comparator connected to the first counter, for comparing raster end point data stored in the second ROM and horizontal address values from the first counter and for generating an end pulse when there is a coincidence therebetween; and timing signal producing means, coupled to said display means, for receiving the start pulse generated by the first comparator and the end pulse generated by the second comparator and for outputting an active raster period signal.

2. An image display according to claim 1, further comprising a RAM, which is connected to the first counter for receiving a horizontal scanning end signal therefrom and which is further connected to the second counter for receiving therefrom a count value for designating a vertical address, said RAM outputting, as a video signal, display data stored at the designated vertical address.

3. An image display device according to claim 1, further comprising:

a RAM, which is connected to the first counter so as to receive a horizontal scanning end signal therefrom and which is further connected to the second counter so as to receive therefrom a count value for designating a vertical address, said RAM outputting, as a video signal, display data stored at the designated vertical address; and gate means for receiving, as a gate input, an output of said timing producing means and an output of said RAM, and for outputting a video signal in accordance with a raster signal generation period which is determined by said start pulse and said end pulse.

* * * * *